US005678988A

United States Patent [19]

Amrhein et al.

[11] Patent Number: 5,678,988

[45] Date of Patent: Oct. 21, 1997

[54] BLOWER FOR GAS PREMIX BURNERS

[75] Inventors: Wolfgang Amrhein, Ottensheim, Austria; Fritz Schmider, Hornberg, Germany

[73] Assignee: Papst-Motoren GmbH & Co. KG, St. Georgen, Germany

[21] Appl. No.: 350,207

[22] Filed: Dec. 5, 1994

[30] Foreign Application Priority Data

Dec. 6, 1993 [DE] Germany ..... 43 41 340.4

[51] Int. Cl.[6] ..... F23D 14/14; F04B 17/00

[52] U.S. Cl. ..... 431/328; 431/7; 417/354; 417/368

[58] Field of Search ..... 431/326, 328, 431/329, 7, 170, 18, 23; 417/353, 354, 366, 368

[56] References Cited

U.S. PATENT DOCUMENTS

| | | | |
|---|---|---|---|
| 2,711,285 | 6/1955 | Burrowes | 417/353 |
| 4,428,719 | 1/1984 | Hayashibara et al. | 417/354 |
| 4,564,335 | 1/1986 | Harmsen et al. | 417/354 |
| 4,830,600 | 5/1989 | VerShaw . | |
| 5,135,363 | 8/1992 | Harmsen et al. | 417/353 |
| 5,474,443 | 12/1995 | Viessmann et al. | 431/328 |

FOREIGN PATENT DOCUMENTS

| | | | |
|---|---|---|---|
| 591896 | 2/1960 | Canada | 417/354 |
| 3614748 | 1/1987 | Germany | 417/354 |
| 4011691 | 10/1990 | Germany . | |
| 403275998 | 12/1991 | Japan | 417/354 |
| WO9014557 | 11/1990 | WIPO | 431/328 |

*Primary Examiner*—Carl D. Price
*Attorney, Agent, or Firm*—Jones & Askew, LLP

[57] ABSTRACT

A gas premix burner in which gas and air are mixed in a suction region of an impeller to form a combustion mixture. The impeller is associated with a blower housing and an electronic control circuit board, all of which are arranged upstream in a blower chamber having at least one time separating wall. The arrangement prevents the gas and the combustion mixture from reaching the motor landings or the primed circuit board.

31 Claims, 8 Drawing Sheets

BLOWER FOR GAS PREMIX BURNERS

BACKGROUND OF THE INVENTION

The present invention pertains to a blower for gas premix burners, in particular for the combustion of gas in heating furnaces, with a blower chamber that has at least one flame separating wall that is permeable to the combustion mixture and is provided with openings for said combustion mixture, whereby a blower housing part, an impeller and a blower electronics unit is arranged upstream of the blower chamber viewed in the flow direction.

In known burner blowers, primarily in gas burner blowers, the combustible mixture (e.g., air+gas) mixed upstream or downstream of the blower, but upstream of the burner is conveyed into the combustion chamber by means of the blower and ignited in said combustion chamber. This causes certain sealing problems even before the mixture is introduced into the blower housing part as well as a high mechanical expenditure and a large structural space for supply lines and fastening elements. In addition, the combustible and in most instances aggressive mixture may reach the inner region of the blower drive, so that said mixture may damage sensitive components of the electronics, bearing parts, etc., at this location or an ignition of the gas mixture may occur in the winding or the printed circuit board if sparks are created.

SUMMARY OF THE INVENTION

The present invention is based on the objective of eliminating the aforementioned disadvantages and creating a burner blower in which a contact between the gas or the combustion mixture and the blower electronics unit and the electric driving motor is avoided.

According to the invention, this objective is attained by arranging the impeller inside of the blower chamber, and combining the components of the combustion mixture within the suction region of the impeller.

Consequently, the present invention is based on the idea that the known disadvantages may be eliminated due to the fact that only the air to be mixed into the combustion mixture flows within the region of the motor electronics unit and the electric driving motor, and that such a pressure difference is generated inside of the blower chamber that the combustion mixture and the combustion gas to be mixed with the air are present only in a suction region of the blower. In addition, these measures provide the advantage that the combustion mixture is discharged into the blower chamber without having to provide additional housing parts that convey the combustion mixture.

BRIEF DESCRIPTION OF THE DRAWING

The invention is described in detail below with reference to the embodiments illustrated in the figures. The figures show.

DESCRIPTION OF THE PREFERRED EMBODIMENTS

Figure 1:
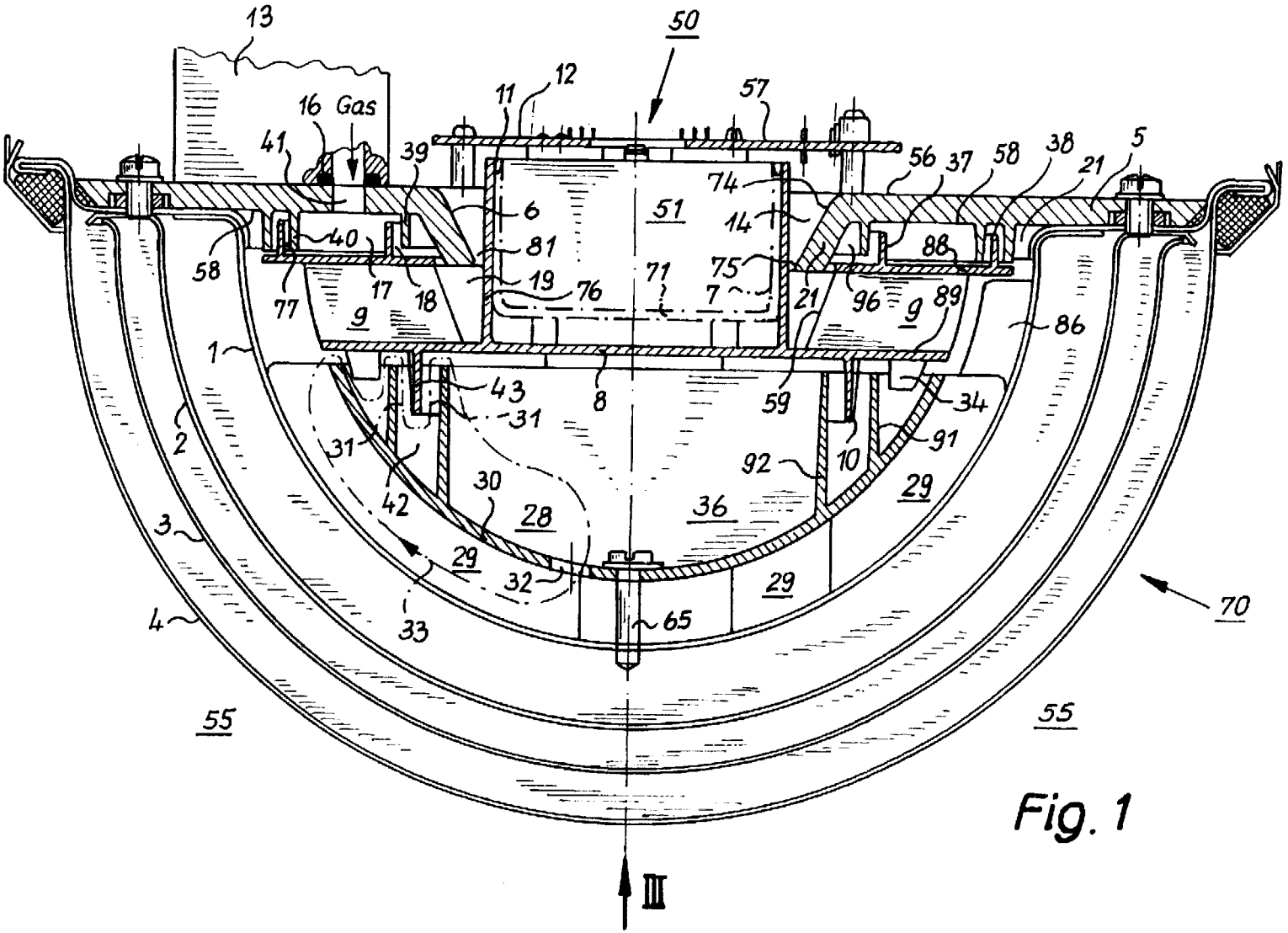
FIG. 1 a section through a first embodiment of a burner blower according to the invention, FIG. 2 a section through a second embodiment of the invention without a displacer element, FIG. 3 a displacer element according to the invention viewed in the direction indicated by the arrow III in FIG. 1, FIG. 4 a first detail of a flame separating wall, FIG. 5 a second detail of a flame separating wall, FIG. 6 a section through a third embodiment of the invention, FIG. 7 a section through a fourth embodiment of the invention, FIG. 8 a detail of a housing part according to the invention, FIG. 9 a section through an additional embodiment of the invention, FIG. 10 a view of the inner side of the housing part according to FIG. 9, and FIG. 11 a view of the outer side of the housing part according to FIG. 9.

FIG. 1 shows a burner blower 50 that is situated inside of a combustion chamber 55, e.g., a gas heating furnace. The blower 50 has a driving motor 51 that is fastened onto a blower housing part 5. In the example shown, the housing part 5 is designed as a flange plate, into the first opening 6 of which the driving motor 51 penetrates, namely in the direction of the combustion chamber 55. A gap 14, in particular an annular gap 14, is formed between the outer surface of a rotor 7 of the driving motor 51 and the wall of the opening 6, whereby said gap may have a narrowing 81 in the axial and/or peripheral direction. The gap 14 preferably is narrowed in the flow direction. The narrowing should be designed without abrupt transitions, such as curves 74,75, in order to favorably affect the flow characteristics.

Figure 8:
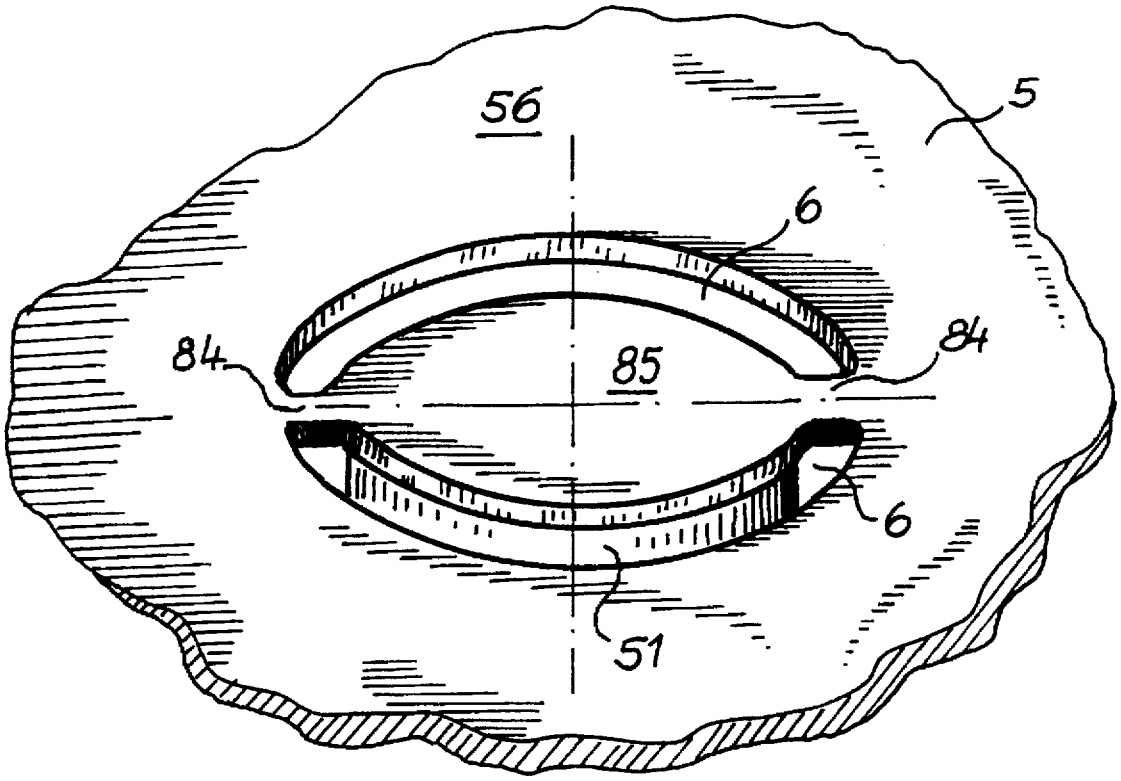

The driving motor 51, preferably a brushless external rotor motor, with its blower electronic 12 and a printed circuit board is connected to the housing part 5 by fastening elements. However, the connection between the driving motor 51 and the housing part 5 also may be realized by fixed links 84 that are molded onto the housing part (FIG. 8).

A support part that is designed as a pot 76 contains an impeller 8 with blades 9, preferably in the forth of a one-piece molded or cast part. The pot 76 is fastened on the outer surface of the pot-shaped rotor 7 of the driving motor 51 by means of bonding and/or a press fit.

Figure 2:
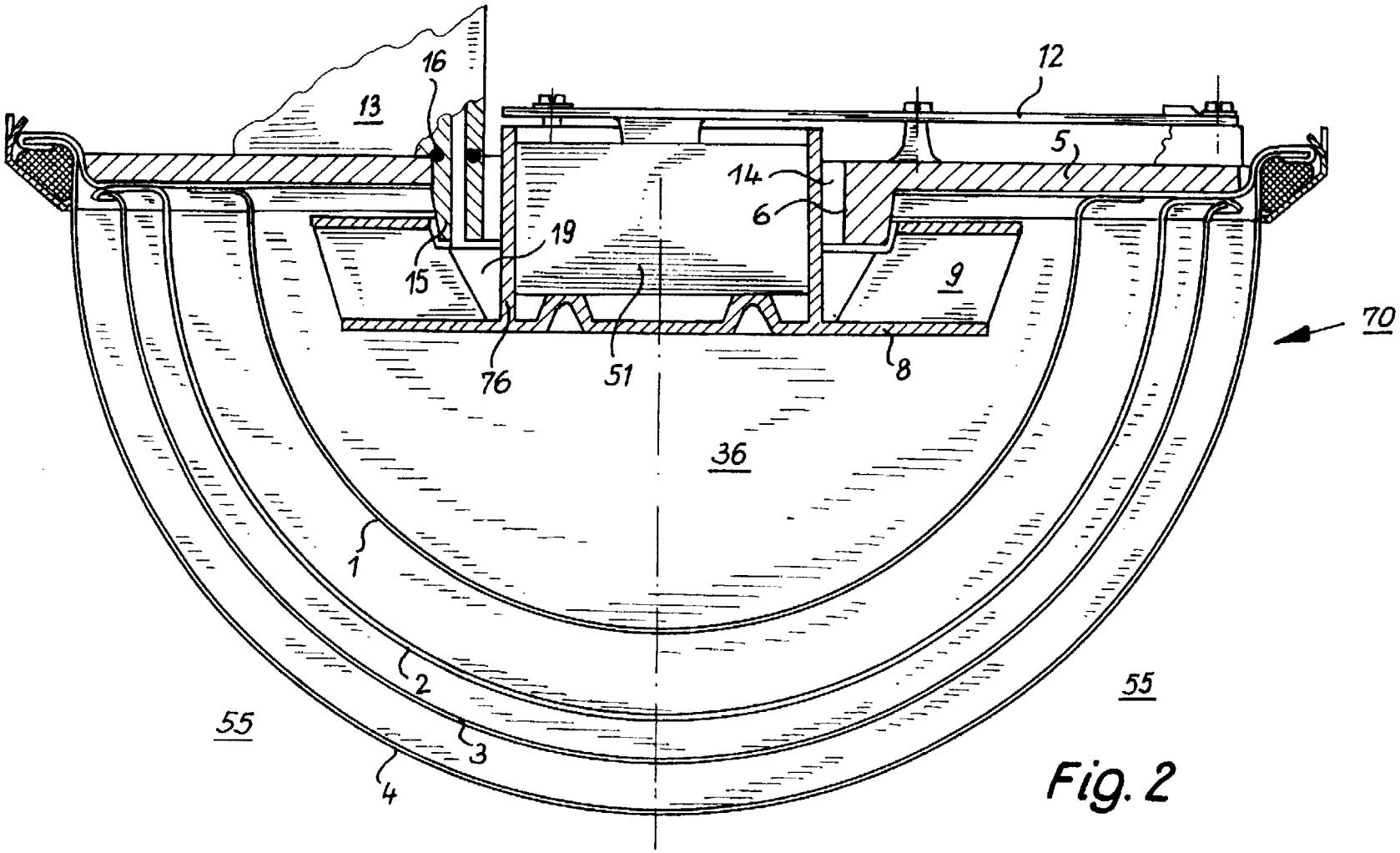

The burner 70 that is illustrated in the embodiments according to FIGS. 1 and 2 has the shape of a hemisphere with flame separating walls 1 through 4 that may be designed as perforated plates having a sieve-like perforation that becomes continuously smaller in the direction extending from the flame separating wall 1 to the flame separating wall 4. The combustion mixture (e.g., air+gas) is discharged from the outer flame separating wall 4 and is ignited at this location. The flame separating walls 2 and 4 essentially are arranged parallel at a distance from one another and fastened onto the housing part 5 via an insulating layer at the end of the semicircle. The inner flame separating wall 1 is arranged centrally to the blower 50 and forms a blower chamber 36, the top of which is limited by the lower side of the housing part 5. The blades 9 of the impeller 8, which in the embodiment shown is designed as a radial impeller, either may be linear or curved toward the front or rear depending on the efficiency and noise requirements. An upper cover 88 and a lower cover 89 limit the impeller 8 in the axial direction and serve as a guidance for the flow of the air or combustion mixture (air+gas). These covers also are part of the connection between a gas supply opening 41 and the blower chamber 36. The gas is supplied via a gas valve 13 that is fastened onto the upper side 56 of the housing part 5 by means of a seal 16. The gas is conveyed via the opening 41 into a gas distribution chamber 17 which is formed between the stationary lower side 58 of the housing part and the rotating cover 88 of the impeller 8. The gas distribution chamber 17 contains a labyrinth seal that is formed by annular webs 38 on the impeller 8 and annular webs 40 on the housing part 5 on the pressure side.

A radial annular gap 77 formed between the webs 37 and 40 and the axial gap between the housing part 5 and the cover 88 are designed so narrow that a gas flow is prevented during a rotation of the impeller 8.

A labyrinth in the form of a bank-up labyrinth that is formed by annular webs and grooves 37,39 on the impeller 8 and the housing part 5 and limited by the impeller 8 and the housing part 5 also is provided on the suction side. The geometric dimensions of the bank-up labyrinth in relation to the annular gaps 18 and the corresponding axial gaps are designed in such a way that, in particular during a rotation of the impeller 8, a ram pressure is created that promotes the distribution of the gas over the entire circumference, whereby the labyrinth gaps are sufficiently wide for insuring the gas flow required for the operation of the burner.

A displacer 28 is arranged in the blower chamber 36 in order to distribute the flow of the combustion mixture. The most important task of this displacer consists of blocking a part of the blower chamber 36 for the main blower flow 83 and causing an even distribution of the flow of the air-gas mixture via the flame separating walls 1 through 4.

Figure 3:
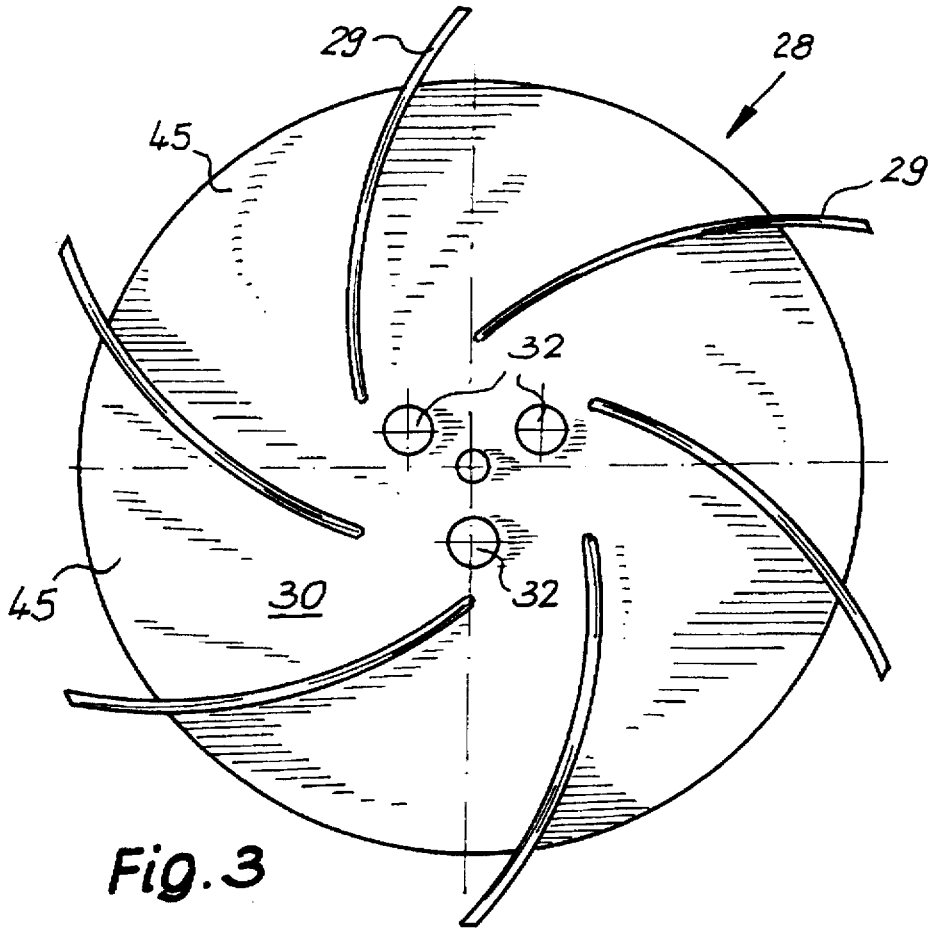

The displacer 28 consists of a body 30, the shape of which essentially is adapted to the time separating walls 1 through 4. The surface of the displacer that faces the flame separating wall 1 is provided with at least one guide blade 29 that is shaped or designed in such a way that it largely prevents a circulation of the combustion mixture around the central axis in the blower chamber 36, whereby the blade 29 in association with the surface of the body 30 and the flame separating wall 1 forms at least one flow channel 45 as shown in FIG. 3.

A lower edge 43 of the impeller 8 penetrates into a fitted recess 42 of the displacer 28 and consequently forms a labyrinth via the gaps 31. This causes a slight circular flow 33 (drawn in dot-dash lines) which is adjusted in a targeted fashion to be created via openings 32 in the base of the body 30 in order to flush out the combustion mixture after the gas valve 13 is locked and the impeller 8 continues to rotate. The displacer 28 may be connected with the flame separating wall 1 by means of screws 65, riveting of the pins (not shown) arranged on the blades 29 or in an analogous fashion.

An additional improvement of the circular flow 33 is obtained by means of radial blades 34 that are arranged on the lower side of the lower cover 89 within the radial outer region of the blower edge 8 and, if necessary, penetrate into an annular recess 49 of the body 30. Instead of or in addition to the displacer 28, the flame separating wall 1 that is designed as a perforated plate also may be provided with a special perforation, as is illustrated in an enlarged fashion in FIGS. 4 and 5, so as to obtain an even distribution of the combustion mixture.

Figure 4:
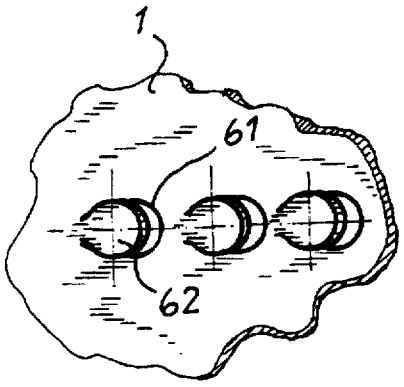
Figure 5:
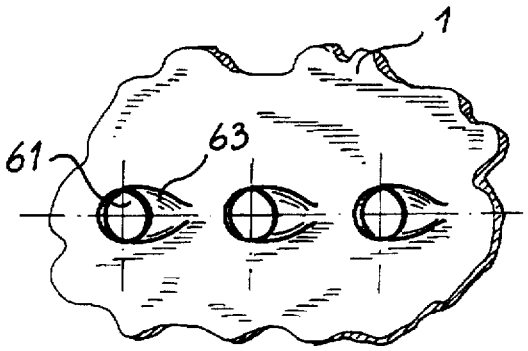

In FIG. 4, the perforations 61 of the flame separating wall 1 are not punched out entirely. In this case, tabs 62 that allow a predetermined flow of the combustion mixture remain due to the fact that the perforations were only punched out partially. In FIG. 5, the perforations 61 are punched out entirely, with the rear sides 63 of said perforations arranged in an upright fashion as on a rasp.

The flame separating walls 1 through 4 may be designed as perforated plates, as metal screens or as ceramic plates that are provided with holes or pores.

Figure 6:
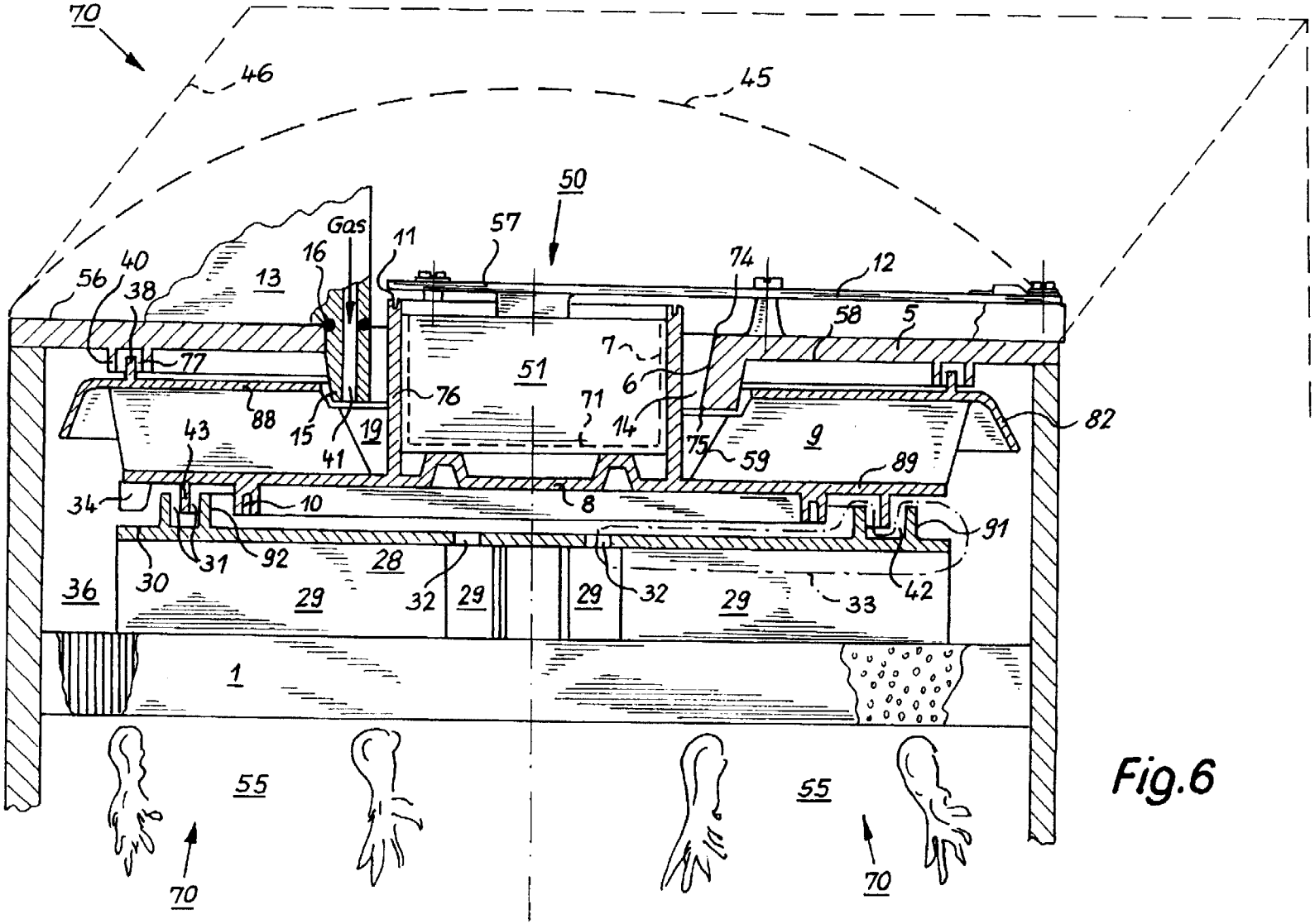

In FIG. 6, the burner 70 consists of the housing part 5 and other components described previously, but this particular burner has a different exterior shape. The impeller 8 with the blades 9 in this embodiment is rigidly connected to the rotor 7 of the driving motor 51 via a pot 76 as is the case in the remaining embodiments of this invention. Here, however, the gas is conveyed directly into the space 19 between the inner edges 59 of the blades 9 and the pot 76 through the opening 41 via a gas nozzle 15. A negative pressure which simultaneously draws in the air required for producing the combustion mixture through the gap 14 is created in the space 19 due to the rotation of the impeller 8. In this case, the air flow initially is also conveyed to the printed-circuit board and the driving motor 51 while passing over the electronics unit 12 and simultaneously cooling it. The flame separating wall 1 (in this case only one separating wall) illustrated in this figure is provided with perforations on the left side and pores on the right side, whereby the combustion mixture is conveyed through said perforations and pores, namely via the impeller 8 as described previously. In order to obtain a targeted flow of the combustion mixture, the upper cover 88 of the impeller 8 is provided with an edge 82 that partially or entirely encompasses the blades 9 that may protrude radially over the lower cover 89 at the outer edge in order to intensify the axial component of the blow direction.

A different variation (not shown) consists of the fact that the covers 88,89 and, if necessary, the blades 9 are tilted in the direction of the lower part of the blower chamber 36 with at least their radial outer region.

The displacer 28 of this embodiment has an essentially planar disk-shaped body 30 that is arranged on the flame separating wall 1. In this case, the combustion mixture also is rinsed out in the same fashion as described previously in association with the circular flow 33.

Figure 7:
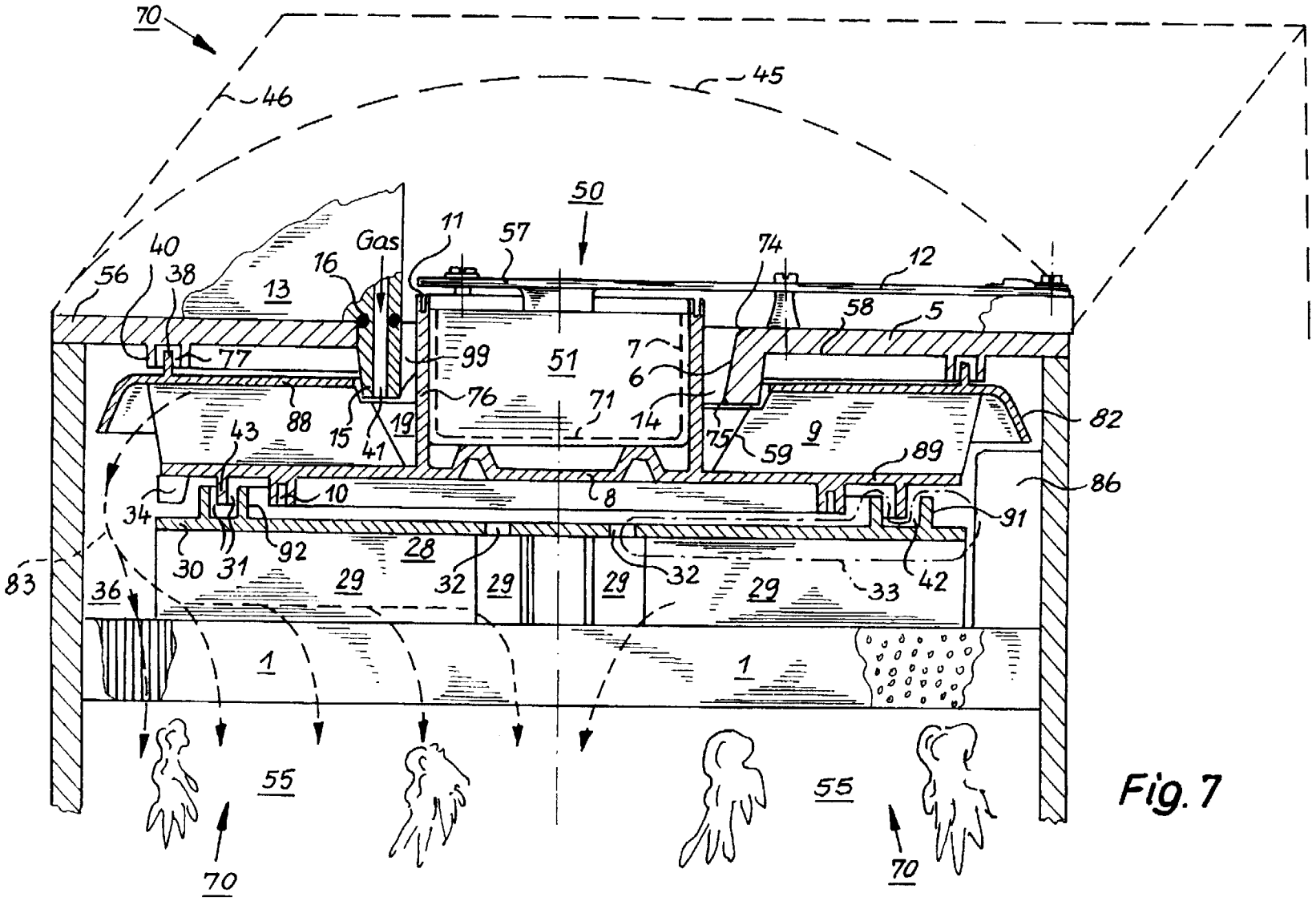

FIG. 7 shows an embodiment that largely corresponds to that shown in FIG. 6, whereby a distribution channel 99 for an even introduction of gas is arranged in the entire gap 14 or at least a partial region of it instead of providing the point-shaped introduction of gas via the nozzle 15. This measure has favorable effects on a more intense and more even formation of the combustion mixture.

Bodies 86 that inhibit the circulating movement of the combustion mixture around the impeller axis are arranged in the blower chamber 36 at the elevation of the impeller, namely within the radial blowing region of the impeller 8. The aforementioned bodies 86 also may be realized as extensions of the displacer guide blades 29.

FIG. 8 shows a detail of one additional embodiment, in particular for fastening the driving motor 51 with its rotor 7 and the corresponding driving electronics. Two segment-like parts are removed from the housing part 5, whereby a flange plate 85 and webs 84 that, for example, are arranged axially and/or radially remain intact. The motor 51 is fastened onto this flange plate 85 and projects entirely or partially into the burner 70, as the case in the embodiments described previously. In a variation with a planar housing part 5, the blower is entirely integrated into the burner.

It is important for the invention that the outlets (in the flow direction) of the openings 6,41 terminate in a suction region 14,17,18,19 of the interior of the burner 70.

Receptacle devices 10,11 are provided in two separate planes in order to realize the dynamic counterbalancing of the impeller 8. It is advantageous if the receptacle devices are provided in the form of annular depressions on the upper edge of the pot 76, whereby the depressions 10 also may be designed as pockets in which the counterbalancing weights are accommodated. The impeller 8 may—depending on the requirements—be designed in such a way that its blow direction preferably extends in the radial direction, in the axial direction or in a direction with an axial as well as a radial component, or said impeller may also be an axial impeller.

The base 71 of the rotor 7 faces the combustion chamber 55 so as to protect the driving electronics unit against heat. An additional protection is provided by the continuous cover 89 of the impeller 8 that preferably is arranged at a distance on the base 71 in the direction toward the combustion chamber 55. The displacer 28 additionally provides a triple protection against heat radiation and heat conduction: a relatively cool gas-air mixture that discharges the heat into the combustion chamber 55 flows through the flow channels 45 that are formed by the body 30, its guide plates 29 and the flame separating wall 1. Due to its closed design, the displacer 28 provides a protective shield against the heat radiation originating from the combustion chamber 55. The displacer 28 has a very high heat accumulation capacity, so that the intense heat that occurs when switching off the blower may be absorbed without substantial temperature fluctuations.

FIGS. 6 and 7 show examples of possible variations, namely one cylindrical and one block-shaped burner 45 and 46, respectively, that are drawn in dot-dash lines.

Figure 10:
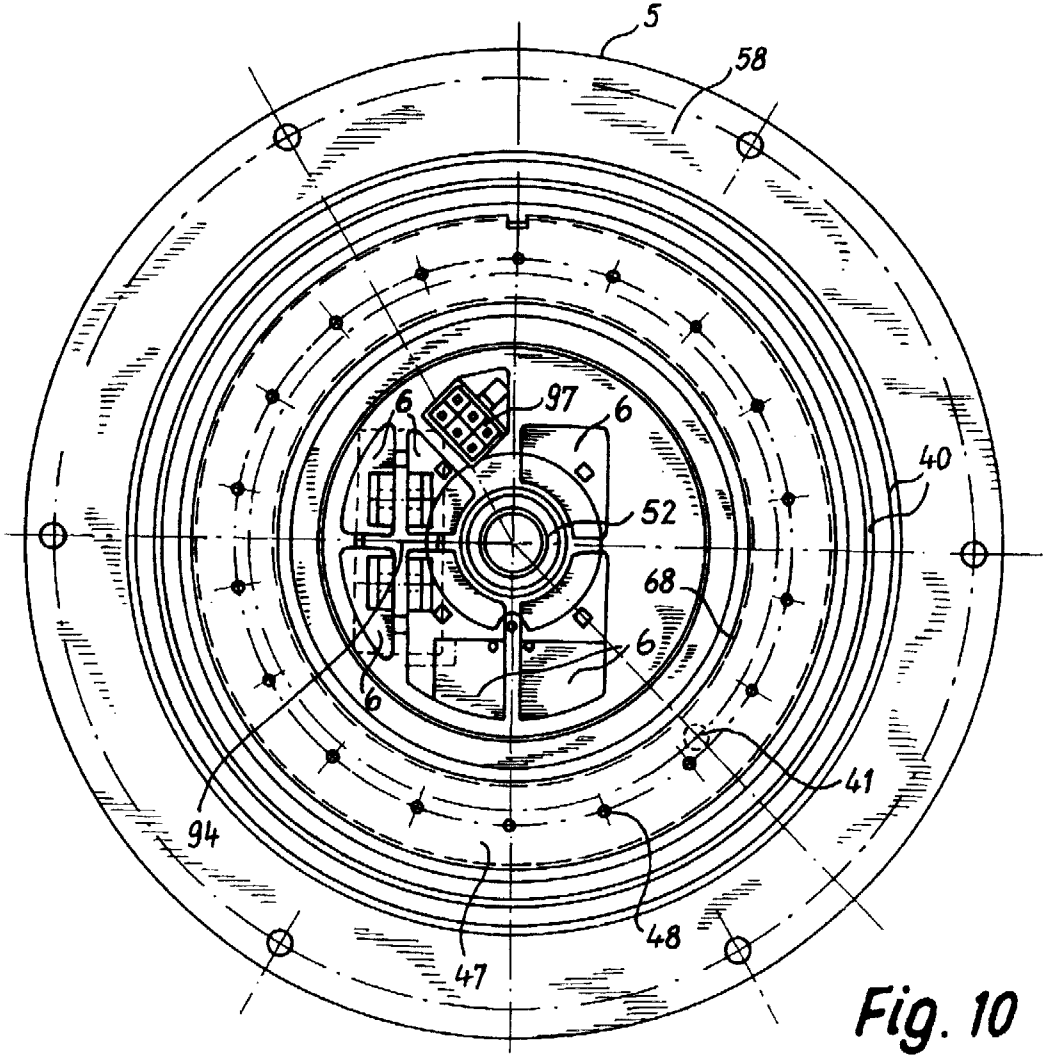
Figure 9:
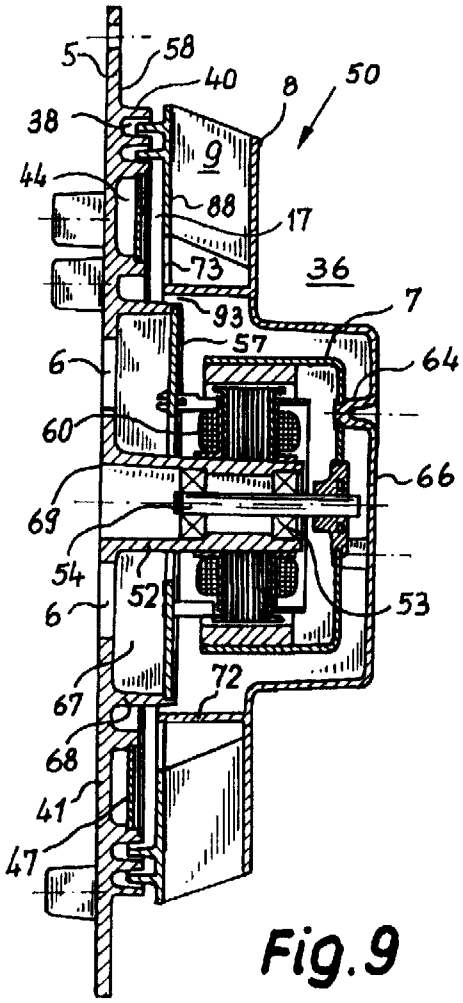
Figure 11:
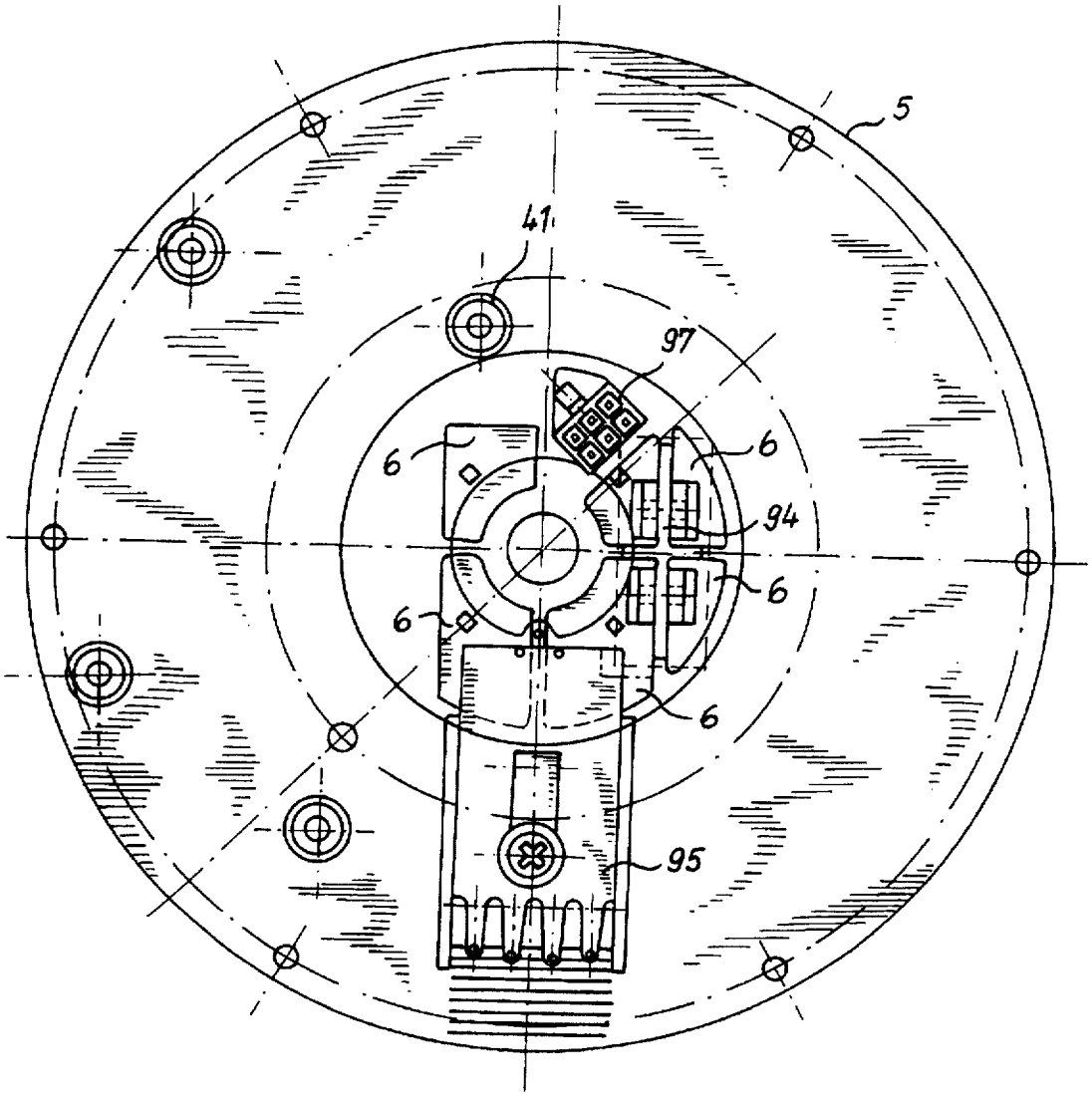

FIGS. 9 through 11 show one additional embodiment of a burner blower 50 according to the invention. In these figures, components that are identical to the components in FIGS. 1 through 8 are identified by identical reference numerals. In addition, it should be noted that the variations illustrated in FIGS. 1 through 8 can, with respect to the design of the individual components, also be combined with the embodiments illustrated in FIGS. 9 through 11.

In the embodiment illustrated in FIGS. 9 through 11, a bearing stay pipe 52 is molded onto the inner side of the housing part 5 that is designed as a flange plate. Bearings 53 for a motor shaft 54 of the motor blower 50 are arranged in this bearing stay pipe 52. The impeller 8 is fastened onto the end of the motor shaft 54 that protrudes out of the bearing stay pipe 52, whereby said impeller is connected with the rotor 7. The stator 60 of the motor blower 50 is arranged concentrically on the bearing stay pipe 52. The impeller 8 has a pot-shaped receptacle part 66 into which the rotor 7 protrudes. In this case, the rotor 7 is connected to the base of the receptacle part 66 via spacers 64 such that they rotate together. In this particular embodiment, the receptacle part 66 forms a heat shield for the motor. Openings 6 that serve for supplying air and exit into an annular chamber 67 around the bearing stay pipe 52 are arranged in the housing part 5 around the bearing stay pipe 52. The side of the chamber situated opposite to the openings 6 is formed by the electronic carrier (printed-circuit board) 57 that is fastened onto the stator 60 and tightly adjoins an annular web 68 of the housing part 5 with its outer edge. Consequently, the air flows directly against the electronics substrate 57 such that a superior cooling of said element is attained.

An annular gap 69 through which the air flows from the chamber 67 into the center of the impeller 8 is arranged between the inner edge of the printed-circuit board 57 and the bearing stay pipe 52. The blades 9 of the impeller 8 have an inner, annular face wall 72 that partially encompasses the annular web 68 in a concentric fashion, whereby a choke gap 93 that represents the location of the most intense pressure drop within the flow region is formed in this area. The choke gap 93 exits into the gas distribution chamber 17 that lies in the suction region of the blower. The gas supply opening 41 provided in the blower housing part 5 exits into an annular gas chamber 44 that is closed on its inner side by means of a circular ring disk 47. Openings 48 through which the gas flows into the gas distribution chamber 17 while being evenly distributed over the circumference are arranged on a circle in the circular ring disk 47, in particular at identical spacing from one another. The cover 88 of the impeller 8 that faces the housing part 5 forms with its inner edge an annular opening 73 that is situated opposite the face wall 72. This opening approximately defines the location of the lowest pressure in the blower, whereby the air and the introduced gas are mixed in this opening, and the combustion mixture created in this way flows into the impeller 8 due to the existing suction. The mixing of the air-gas mixture consequently takes place inside of the blower chamber 36, specifically, within a region that is situated at a distance from the electric components. In this case, the flow path according to the invention, namely the existing pressure ratios, prevent gas or the gas-air mixture from reaching the region of the electric motor or its electronic controls.

In addition, webs 94 are formed onto the outer side of the housing part 5, whereby said webs in particular are arranged within the region of the suction opening 6. These webs 94 serve as cooling and fastening elements for the power transistors of the motor electronics unit.

In addition, it may be practical to fasten a slide arrangement 95 on the housing part 5 within the region of the suction opening 14. This slide arrangement makes it possible to alter the effective flow cross section of the suction openings 14. The figures also show that electric contacts 97 are provided within the region of the suction opening 14.

The invention is not limited to the embodiments that are illustrated in the figures and were described previously, but rather includes all embodiments that function in the same fashion as the invention.

We claim:

1. A gas premix burner blower for the combustion of gas in a heating furnace, comprising:

a blower chamber that has at least one flame separating wall which is permeable to a combustion mixture comprising gas and air components and is provided with openings for said combustion mixture;

a blower housing located at least partially within the blower chamber;

an impeller operatively associated with the blower housing and located in the blower chamber downstream of the blower housing, viewed in a predetermined flow direction of the impeller; and the impeller (8) inside of the blower chamber (36) having a suction region operative to receive the components of the combustion mixture. So that the gas component is combined with the air component downstream of the blower housing in the suction region of the impeller (8) whereby to avoid contact between the gas component and the combustion mixture and an electrical element in the blower housing.

2. Burner blower according to claim 1, wherein the housing (5) has openings (6,41) for the supply of air and gas.

3. Burner blower according to claim 2, wherein the supply of gas takes place with a suction region (14) of the air supply.

4. Burner blower according to claim 2, wherein the air supply opening (6) is arranged within the region of a driving motor (51) of the impeller (8).

5. Burner blower according to claim 4, wherein a gap (14) is formed between an outer surface of a rotor (7) of the driving motor (51) and the wall of opening (6).

6. Blower according to claim 5, wherein the gap (14) has at least one narrowing (81) in at least one of the axial and circumferential directions along the flow path of the gap.

7. Burner blower according to claim 5, wherein the impeller (8) is directly coupled with the rotor (7) of the driving motor (51).

8. Burner blower according to claim 5, wherein a base (71) of the rotor (7) faces the combustion chamber (55).

9. Burner blower according to claim 5, an electronics unit for the driving motor (51) is accommodated inside of an outer diameter of the rotor (7).

10. Burner blower according to claim 4, wherein the driving motor (51) is an external rotor motor without a collector.

11. Burner blower according to claim 4, wherein the driving motor (51) is a motor with a reluctant auxiliary moment.

12. Burner blower according to claim 4, wherein blades of the impeller (8) are situated in an opening between the housing (5) and rotor of the motor (51) and protrude into this opening.

13. Burner blower according to claim 4, wherein the motor (51) entirely penetrates into the air supply opening (6).

14. Burner blower according to claim 2, wherein electrical components to be cooled are accommodated within an air intake region of the opening (14) for the supply of air.

15. Burner blower according to claim 1, wherein the gas is supplied via at least one gas nozzle (15).

16. Burner blower according to claim 1, wherein the gas is supplied via at least one distribution channel (99).

17. Burner blower according to claim 1, wherein the blow direction of the impeller (8) extends in either the radial or axial direction or in a direction with an axial as well as a radial component.

18. Burner blower according claim 1, wherein the impeller (8) is provided with an upper cover (88) and a lower cover (89).

19. Burner blower according to claim 18, wherein the supply of gas takes place between a lower side (58) of the housing part (5) and the upper cover (88) of the impeller (8).

20. Burner blower according to claim 19, comprising a gas distribution chamber (17) formed between the lower side (58) of the housing part (5) and the upper cover (88) of the impeller (8).

21. Burner blower according to claim 20, wherein the gas distribution chamber (17) is limited toward a pressure side by a labyrinth seal that is formed by annular webs or grooves (38,40) on the impeller (8) and the housing (5), and that the geometric dimensions of the labyrinth seal are, with respect to annular gaps (77) and axial gaps of the labyrinth seal, operative to impair the flow of gas during rotation of the impeller (8).

22. Burner blower according to claim 20, wherein the gas distribution chamber (17) is limited toward the suction side by a bank-up labyrinth that is formed by annular webs or grooves (37,39) on the impeller (8) and the housing part (5), and the geometric dimensions of the bank-up labyrinth are, with respect to the annular gaps (18) and the axial gaps operative to create a ram pressure that promotes the distribution of the gas over the entire circumference of the bank-up labyrinth during a rotation of the impeller (8), whereby the labyrinth gap is sufficiently large to insure the gas flow required for the operation of the burner.

23. Burner blower according to claim 18, wherein the upper cover (88) at least partially on an outer edge blades (9) that may protrude radially over the lower cover (89) so as to intensify the axial component of the blow direction.

24. Burner blower according to claim 23, wherein the covers (88,89) and the blades (9) of the impeller (8) are tilted in the direction of a lower part of the blower chamber (36) at least with their radial outer region so as to intensify the axial component of the blow direction.

25. Burner blower according to claim 1, wherein a displacer (28) is arranged in the blower chamber (36).

26. Burner blower according to claim 25, wherein the displacer (28) includes at least one guide blade (29) that substantially prevents circulation of the combustion mixture around a central axis in the blower chamber (36).

27. Burner blower according to claim 26, wherein the guide blades (29), in association with a body (30) of the displacer (28) and the flame separating wall (1), form flow channels (45).

28. Burner blower according to claim 27, wherein bodies (86) that inhibit a circulating movement of the combustion mixture around the impeller axis are arranged in the blower chamber (36) within a radial blow region of the impeller (8), whereby said bodies are extensions of the displacer guide blades (29).

29. Burner blower according to claim 25, wherein a lower edge (43) of the impeller (8) penetrates into a recess of the displacer (28).

30. Burner blower according to claim 25, wherein radial blades (34) that penetrate into an annular recess (49) of the displacer (28) are arranged on a lower side of a cover (89) of the impeller (8) within radial outer region or the impeller.

31. Burner blower according to claim 25, wherein openings (32) are provided in a lower region of the body (30) of a displacer (28) so as to attain a circular flow (33) that rinses out the combustion mixture.

* * * * *